US007063452B2

(12) United States Patent
Kuo

(10) Patent No.: US 7,063,452 B2
(45) Date of Patent: Jun. 20, 2006

(54) ASSEMBLY OF A FLASH-LAMP STRING SYSTEM

(76) Inventor: Cheng-Ji Kuo, P.O. Box 96-405, Taipei 106 (TW)

( * ) Notice: Subject to any disclaimer, the term of this patent is extended or adjusted under 35 U.S.C. 154(b) by 120 days.

(21) Appl. No.: 10/750,763

(22) Filed: Jan. 5, 2004

(65) Prior Publication Data

US 2005/0146873 A1 Jul. 7, 2005

(51) Int. Cl.
*F21V 21/08* (2006.01)
*H01R 33/00* (2006.01)

(52) U.S. Cl. ..... 362/653; 362/249; 362/391

(58) Field of Classification Search ..... 362/651, 362/652, 653, 654, 249, 252, 806, 391
See application file for complete search history.

(56) References Cited

U.S. PATENT DOCUMENTS

| | | | | |
|---|---|---|---|---|
| 6,376,974 | B1 * | 4/2002 | Tsai | 313/318.01 |
| 6,474,841 | B1 | 11/2002 | Rahman | 362/252 |
| 6,799,867 | B1 * | 10/2004 | Cheng | 362/249 |
| 2004/0257809 | A1 * | 12/2004 | Wu | 362/251 |

* cited by examiner

*Primary Examiner*—Stephen Husar
*Assistant Examiner*—Peggy A. Neils
(74) *Attorney, Agent, or Firm*—Troxell Law Office, PLLC

(57) ABSTRACT

An assembly of a flash-lamp string system comprising a plurality of flash-lamp strings connected in series so as to form into an elongate lamp string; the elongate lamp string includes at least two different flash-lamp strings in terms of flashing type; the outer shape of the two different flash-lamp strings is the same; the bulb socket and the bulb assembly of every aforesaid flash-lamp string can be mounted together within the same flash-lamp string; in other words, the bulb socket and bulb assembly can not be exchanged with that of the different type of flash-lamp string in order to avoid overload of power supply.

5 Claims, 11 Drawing Sheets

ASSEMBLY OF A FLASH-LAMP STRING SYSTEM

BACKGROUND OF THE INVENTION

1. Field of the Invention

This invention relates to a flash-lamp system, and particularly to a flash-lamp string comprising two different types of flash-lamp strings.

2. Description of the Prior Art

In a conventional flash-lamp string usually comprises a separate power-supply wire connected with a plurality of lamp sockets which are connected in series; the last lamp socket on the end of the string is connected with a separate power-supply wire; then, the two separate power-supply wires are twisted together to form into a lamp string; each socket is mounted with a bulb; the lamp string is used as a decoration; every lamp string is mounted with a thermal cut-out bulb so as to have all the rest bulbs turned on and off continuously, i.e., to provide a flash effect. A plurality of lamp strings can be connected in parallel, and twisted into an elongate lamp string; such an elongate lamp string is referred as a regular flash-lamp string.

A conventional flash-lamp string comprises a plurality of lamp sockets connected in series, and some of the lamp sockets are mounted with thermal cut-out bulbs so as to reduce the current flow in the lamp string, and have the rest bulbs had more brightness; in other words, when the thermal cut-out bulbs are turned off, the rest bulbs would provide more brightness because of gaining more current. Since the thermal cut-out bulbs are turned off at different time, the whole lamp string would provide an irregular variation of brightness; in that case, the bulb in the lamp string must have a tungsten filament able to withstand a higher current so as to provide brightness as desired. Such a lamp string is referred to as a Twinkle lamp string; however, such a lamp string should not be connected with too many thermal cut-out bulbs so as to prevent from causing a danger of overheating.

Another conventional flash-lamp string, such as disclosed in U.S. Pat. No. 6,474,841, includes a plurality of different lamp strings in terms of shape and size; in that case, the regular flash bulb and the winkle flash bulb can not be mounted in a non-compatible lamp socket. According to the embodiment of the aforesaid patent, the difference of shape and size can simply indicate the difference of the bulbs, i.e., a different bulb can not be mounted in a non-compatible lamp socket.

SUMMARY OF THE INVENTION

The prime object of the present invention is to provide a flash-lamp system comprising a plurality of flash-lamp strings connected in parallel; the aforesaid flash-lamp strings include at least two types of flash-lamp strings. The bulb sockets of the different flash-lamp strings are the same in outer shape; however, the bulbs of the two different flash-lamp strings can not be plugged in the bulb sockets of different flash-lamp strings so as to prevent from causing over load of power supply.

Another object of the present invention is to provide a flash-lamp system, in which the lamp assembly of one type of flash-lamp string uses a regular bulb to be mounted in a regular bulb socket, and the bulb socket is to be plugged in a lamp socket of the regular flash-lamp string; the lamp socket of the regular bulb has an elongate body portion, of which the upper portion is furnished with a cylindrical cavity and a rectangular groove. Both sides of the rectangular groove are furnished with two copper connector grooves respectively for mounting copper connectors. After a regular bulb and a lamp socket are assembled together into a bulb assembly, the bulb assembly is plugged in the cylindrical cavity of a lamp socket.

Still another object of the present invention is to provide a flash-lamp assembly, in which the lamp assembly includes a regular bulb socket; the bulb socket of the lamp assembly is mounted with a regular steady flash bulb, which will turn off the lamp assembly upon the flash bulb reaching a thermal cut-out condition; as soon as the temperature of the flash bulb is reduced to a given point, the lamp assembly will be turned on to provide a normal brightness.

A further object of the present invention is to provide a flash-lamp system, in which the lamp assembly of the flash-lamp string is furnished with a winkle bulb socket to be mounted with a winkle steady flash bulb; after a regular bulb is assembled therein, the bulb socket is plugged in the cylindrical cavity of a winkle lamp socket. The bulb and the bulb socket removed from the winkle lamp socket can not be plugged in a regular lamp socket.

A still further object of the present invention is to provide a flash-lamp system, in which the lamp assembly of the flash-lamp string is furnished with winkle bulb socket; then, the lamp socket of every lamp assembly can only be plugged with a winkle bulb and bulb socket.

Yet another object of the present invention is to provide a flash-lamp system, in which the lamp assemblies can be furnished with several winkle sockets to be mounted with several winkle bulbs respectively. By means of the thermal cut-out effect, the bulb will be turned off; in that case, the rest bulbs in the lamp assemblies with gain more current; the alternate turning-off effect of several bulbs will provide an alternate variation of brightness among the bulbs.

DETAILED DESCRIPTION OF THE PREFERRED EMBODIMENT

Figure 1:
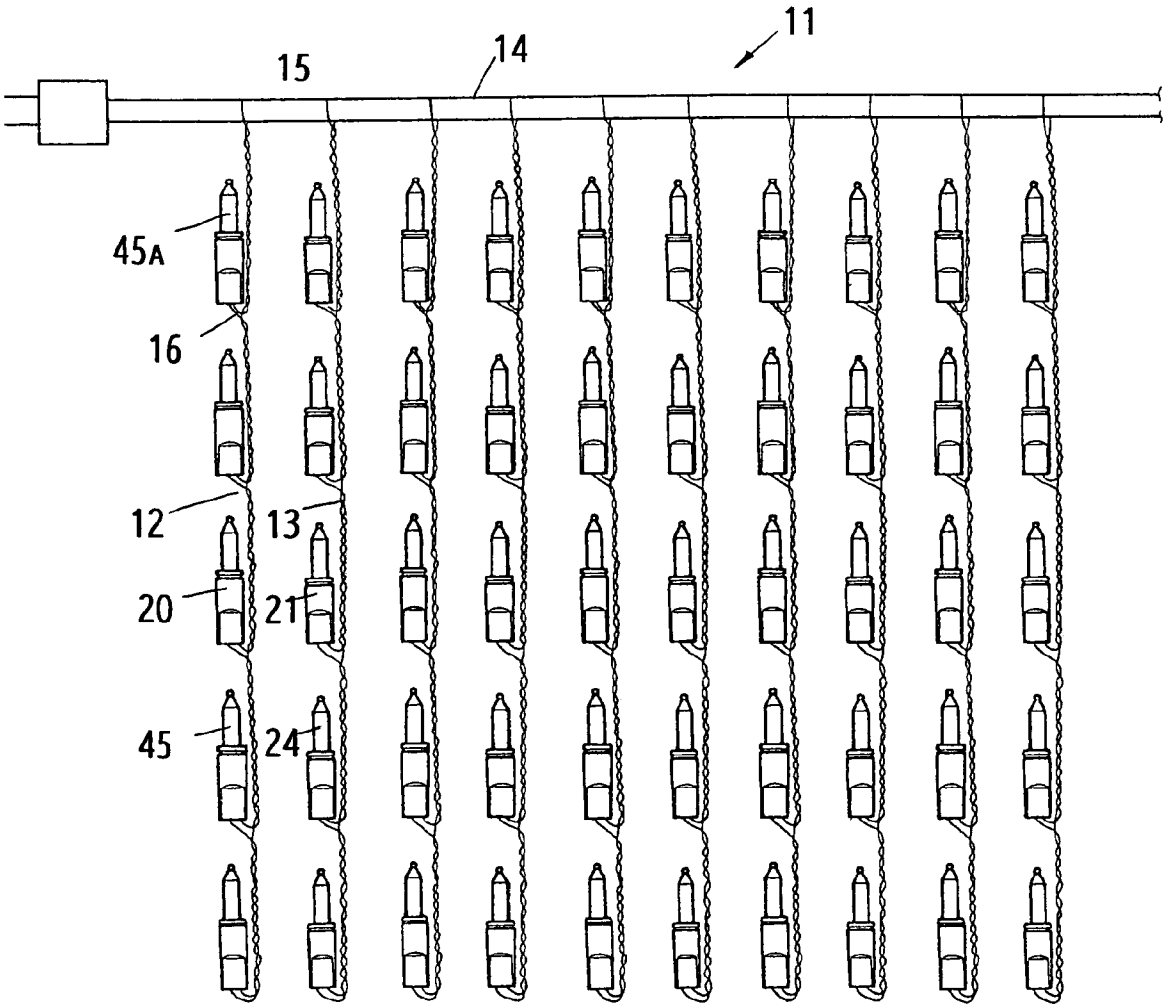
FIG. 1 is a plan view of the present invention, showing a plurality of lamp strings connected in parallel.

This invention relates to a flash-lamp string; as shown in FIG. 1, the flash-lamp system 11 comprises a plurality of flash-lamp strings 12 (or 13) connected, in parallel, with a main power-supply cable 14. The lamp assemblies 20 (or 21) of every flash-lamp strings 12 (or 13) are designed in the same shape. A short power-supply wire 16 is used for connecting, in series, between two lamp assemblies 20 (or 21); then, a long power-supply wire 15 is used for connecting the last lamp assembly with the main power-supply cable 14. A plurality of flash-lamp string 12 (or 13) are twisted or knitted into a long lamp string or a suitable lamp string.

A plurality of flash-lamp strings 12 and 13 can be knitted into a complex flash lamp system 11. The bulbs 45 (or 24) in every lamp assembly 20 (or 21) of one flash-lamp string 12 (or 13) are classified into different kinds by means of the quantity, the resistance value, and the shape of the bulbs. If the first flash-lamp string 12 is designed to use a regular bulb, all bulbs 45 will include a plurality of regular bulbs and one thermal cut-out bulb.

Figure 2:
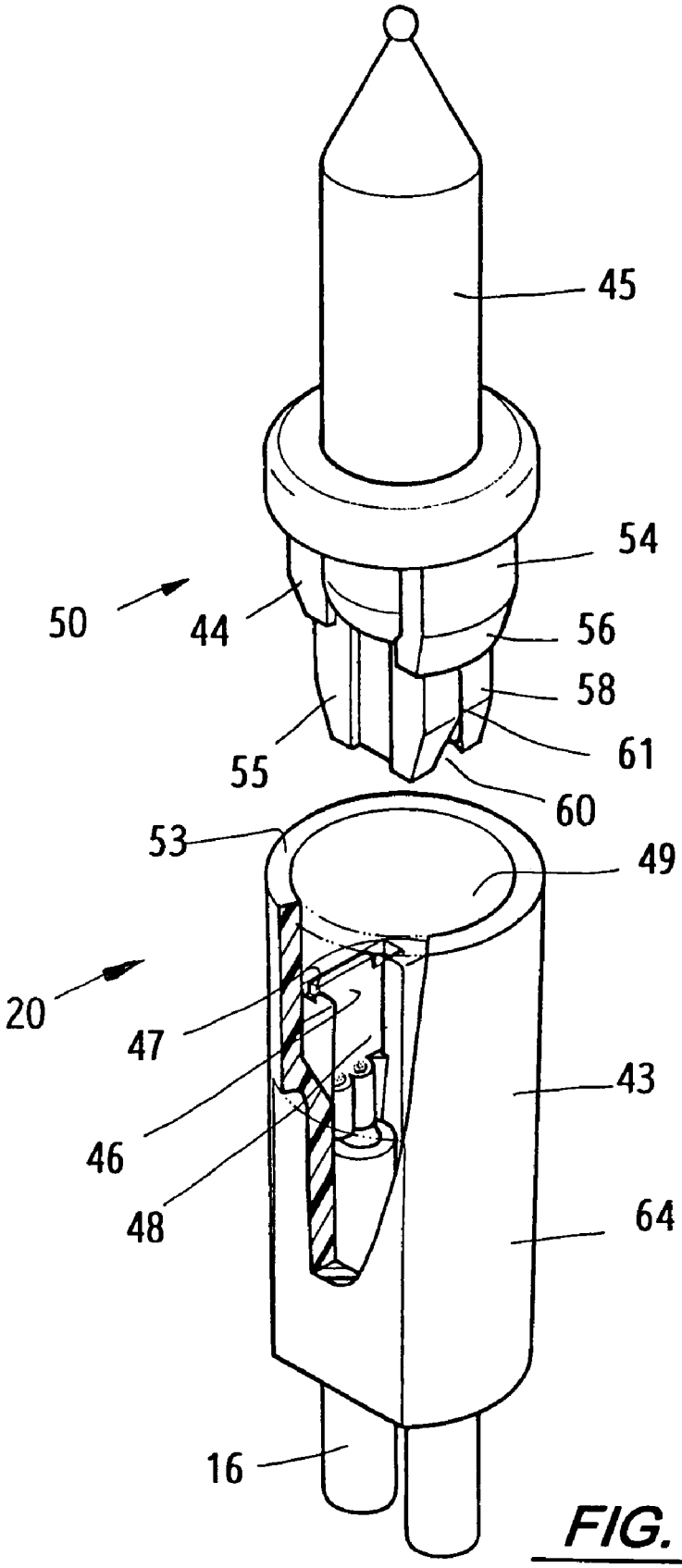
FIG. 2 is a disassembled view-1 of the lamp assembly in a regular flash-lamp string.
Figure 3:
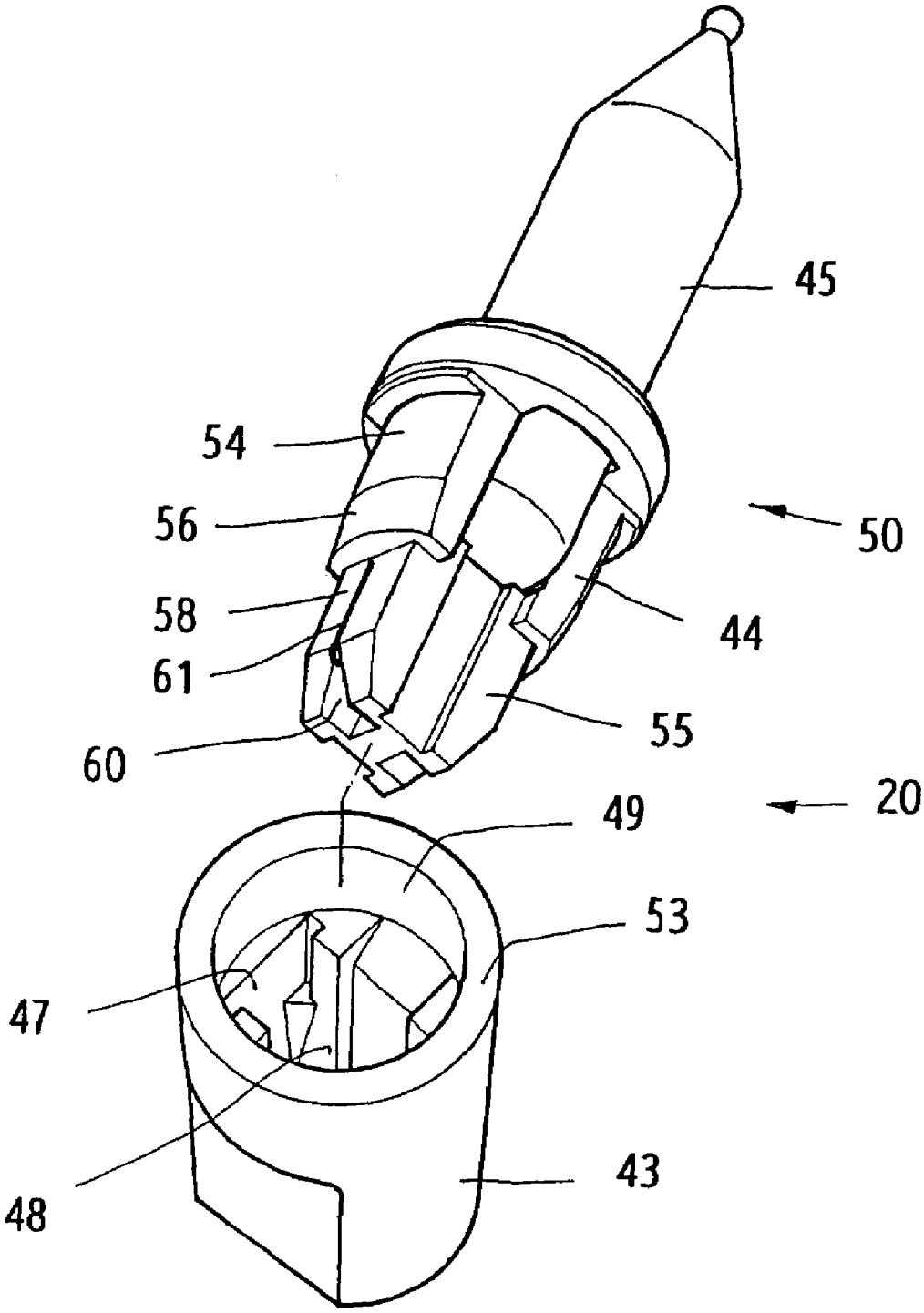
FIG. 3 is a disassembled view-2 of the lamp assembly in a regular flash-lamp string.
Figure 4:
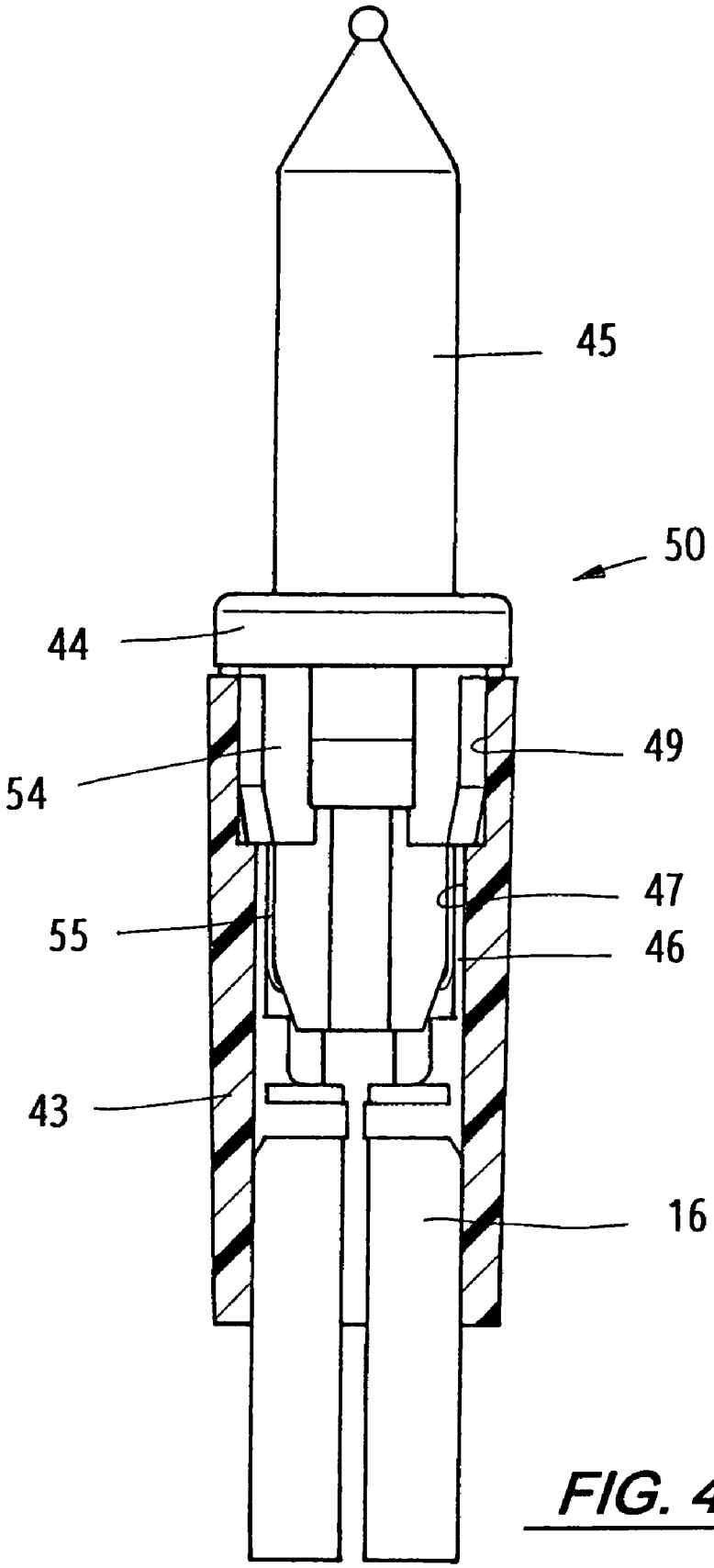
FIG. 4 is a sectional view of a lamp assembly in a regular flash-lamp string.

As shown in FIG. 2, the regular bulb 45 has two copper wires 61 passing two through holes 60 of the bulb socket 44, and being bent towards both sides respectively until contacting a flat surface 58. After the bulb 45 and the bulb socket 44 are assembled together, a bulb assembly 50 is completed; the bulb socket 44 includes a rectangular lower body and a round upper body 54 so as to facilitate the bulb assembly 50 to plug into the lamp socket 43. The upper portion of the lamp socket 43 has a cylindrical cavity 49, of which the bottom center is furnished with a rectangular groove 48; both sides of the rectangular groove 48 are furnished with two copper connector grooves 47 respectively for mounting two copper connectors 46 therein respectively, and the two copper connectors 46 are riveted to the ends of two short power-supply wires 16 respectively, The bulb assembly 50 is plugged into the cylindrical cavity 49 first and then the lower body 55 is plugged into the rectangular groove 48 of the lamp socket 43; then, the upper body 54 is plugged into the cylindrical cavity 49 of the socket 43 so as to have the bulb assembly 50 and the lamp socket 43 assembled together.

In the first flash-lamp string 12 assembled with a plurality of regular lamp assemblies 20, the bulb assembly 50 of the lamp assembly 20 should be replaced with a regular flash bulb 45, which is substantially a bulb 45A mounted with a thermal cut-out copper piece; after the bulb 45A is lit up for a short time, the temperature thereof will raise to a given point to cause the thermal cut-out copper piece to turn off the circuit, i.e., to have the flash-lamp string 12 turned off. As soon as the temperature of the bulb 45A is reduced to a given point, the thermal cut-out copper piece will turn on the copper wire again to have the whole flash-lamp string 12 lit up again. By means of the aforesaid repeated turning on and off, the flash-lamp string 12 is referred to as a regular flash-lamp string.

Figure 5:
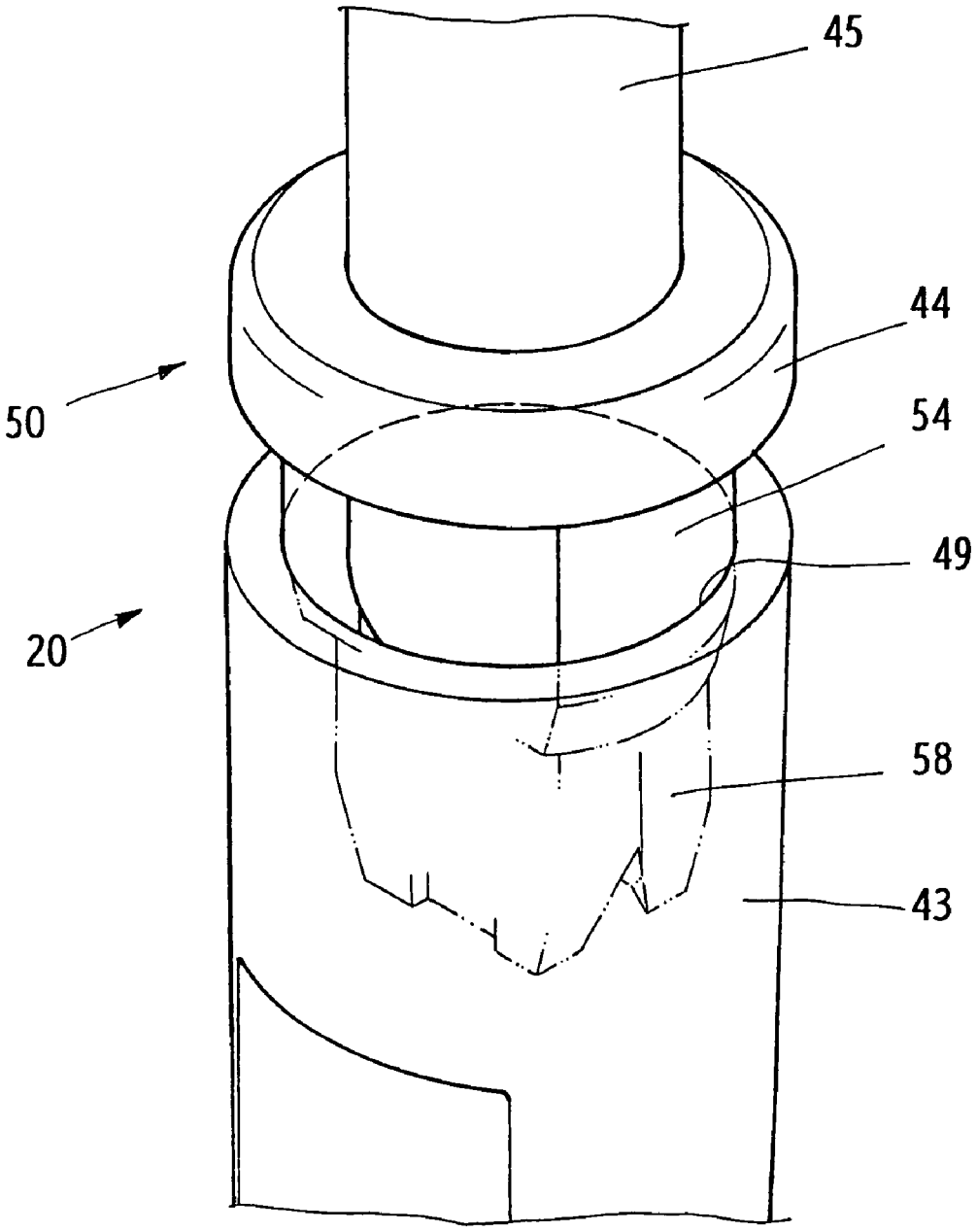
FIG. 5 is a side view of a lamp assembly in a regular flash-lamp string, showing the parts thereof assembled together.

Referring to FIGS. 1 to 4, the bulb assembly 50 in the regular flash-lamp string 12 should be plugged in the lamp socket 22 by means of the lower body 55 plugging in the rectangular groove 48 on the bottom of the cylindrical cavity 49 in the lamp socket 43; as soon as the upper body 54 is mounted in the cylindrical cavity 49 of the lamp socket 43, the copper wires 61 on the flat surfaces 58 on both sides of the lower body 55 will be in contact closely with the copper connectors 46 respectively. As shown in FIG. 5, the bulb assembly 50 can easily and simply be plugged in the cylindrical cavity 49 and the rectangular groove 48 of the lamp socket 43.

Referring to FIG. 1 again, the second flash-lamp string 13 of the flash-lamp system 11 is made of a plurality of twinkle bulbs 24; lamp assemblies 21 in the flash-lamp string 13 include a plurality of regular bulbs and a plurality of thermal-cut-out bulbs. During the repeated thermal cut-out condition, some bulbs of the second flash-lamp string 13 will have more brightness as a result of gaining more current. Since the thermal cut-out time in the string is different, the second flash-lamp string 13 will provide an irregular brightness variation, and then the string can provide more decoration effect; therefore, the tungsten filament in the bulbs of the second flash-lamp string 13 should withstand a higher load of current so as to provide a higher brightness as expected.

Referring to FIGS. 1, 6 to 9, the thermal cut-out bulb and the regular bulbs can withstand a higher load of current, and such winkle lamp string 13 should not be connected with one main power-supply cable in parallel with the regular flash-lamp string 12 because of two different type of bulbs being unable to replace each other; otherwise, a danger may be resulted, or the bulb might be burned out quickly.

For commercial identification, the outer shape of the lamp assembly 20 of the regular flash-lamp string 12 and the lamp assembly 21 of the winkle flash-lamp string 13 is the same; in order to prevent the two types of lamp assemblies from exchanging each other, please reference FIG. 2 the bulb socket 44 and bulb 45 of the regular flash-lamp string 12 are designed in a standard type, except for the lamp socket 43 and the body 64 being longer; however, the plug structure between the lamp socket 43 and the bulb socket 44 is not changed.

Figure 11:
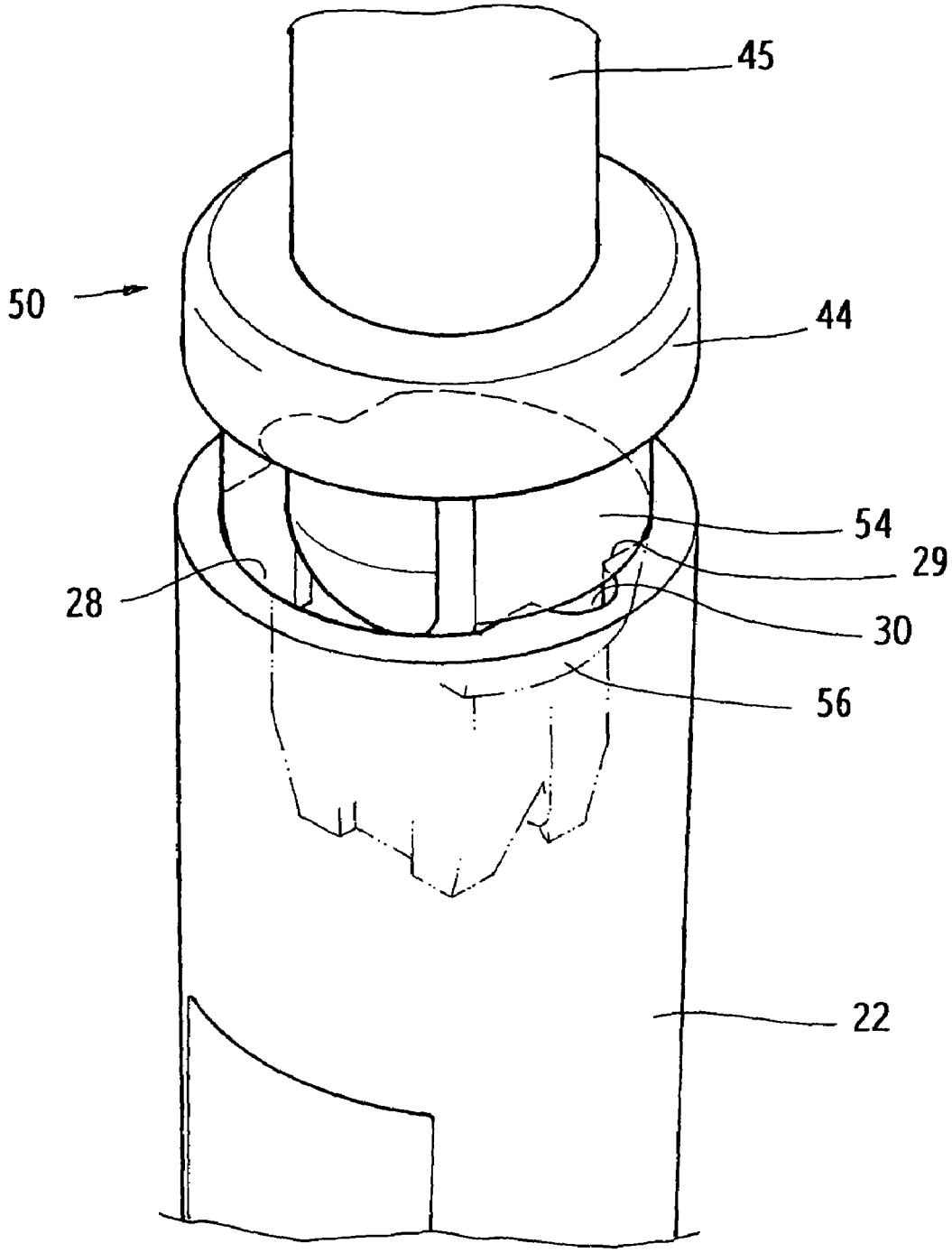
FIG. 11 is a side view of the present invention, showing a lamp assembly of a twinkle flash-lamp string being plugged into a socket of a regular flash-lamp string.

The lamp assembly 21 of the winkle flash-lamp string 13 and the lamp assembly 20 of the regular flash-lamp string 12 have the same outer shape, but the assembling structure between the lamp socket 22 and the bulb socket 23 in the lamp assembly 21 of the winkle flash-lamp string 13 must be changed so as to prevent the bulb sockets 44 and 23 of the two lamp assemblies 20 and 21 from exchanging. The upper portion of the lamp socket 22 in the lamp assembly 21 of the winkle flash-lamp string 13 has a cylindrical cavity 28, of which both sides are furnished with two symmetrical vertical surfaces 29 respectively; each of the vertical surfaces 29 is furnished with a mounting groove 30. The height of the cylindrical cavity 28 is higher than the total height of the lower body 55 and the bevel surface 56 of the bulb socket 44 in the regular flash-lamp string 12; furthermore, the distance between the two vertical surfaces 29 in the cylindrical cavity 29 is smaller than the diameter of the upper body 54 of the bulb socket 44; as shown in FIG. 11, the lamp socket 22 of the winkle flash-lamp string 12 is designed to prevent the bulb assembly 50 of the regular flash-lamp string 12 from plugging therein.

The bulb socket 23 to be plugged in the cylindrical cavity 28 of the lamp socket 22 in the winkle flash-lamp string 13 is furnished with two flanges 35 on both sides thereof; the two flanges 35 are designed to mate with the mounting grooves 30 respectively on the vertical surfaces 29 of the cylindrical cavity 28 of the lamp socket 22 so as to facilitate a bulb socket 23 to plug in, The lower body 34 of the bulb socket 23 is a rectangular member, in which two through holes 39 are furnished to facilitate two copper wires 40 to penetrate outwards; after a bulb 24 is plugged in the cylindrical cavity 28, the two copper wires 40 will be bent to contact closely with two flat surfaces 37 on both sides respectively.

The bulb assembled 51 with a bulb 24 and a bulb socket 23 is to be plugged in the cylindrical cavity 28, and then the lower body 34 of the bulb socket 23 will be guided into the rectangular groove 27 in the lower portion of the cylindrical cavity 28; simultaneously, the two copper wires 40 on the two flat surfaces 37 will be in close contact with the copper connectors respectively in the copper connector grooves 26, while the upper body 33 of the bulb socket 23 is plugged in the cylindrical cavity 28.

Figure 10:
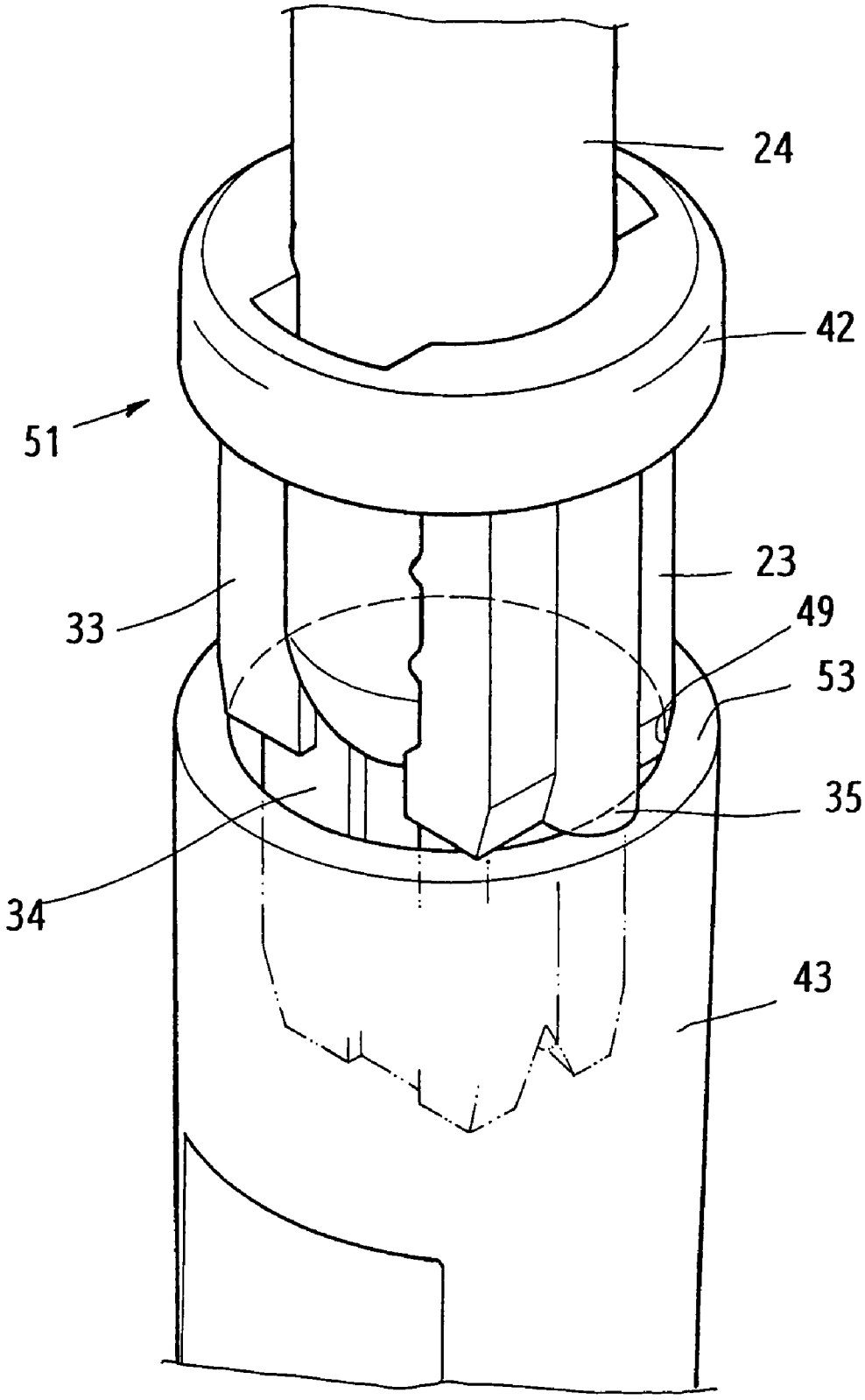
FIG. 10 is a side view of the present invention, showing a lamp assembly of a regular flash-lamp string being plugged into a socket of a twinkle flash-lamp string.

The upper body 33 of the bulb socket 23 in the bulb assembly 51 of the winkle flash-lamp string 13 is furnished with two flanges 35 on both sides thereof, and such bulb assembly 51 can only be plugged in a mated bulb socket 23. As shown in FIGS. 2 and 10, when the bulb assembly 51 is tried to plug in the lamp socket 43 of the regular flash-lamp string 12, the lower body 34 of the bulb socket 23 of the bulb assembly 51 is guided in the cylindrical cavity 49 of the lamp socket 43, but it can not be plugged in as a result of the flanges 35 on both sides of the upper body 33, i.e., the flanges 35 will be hindered with the top surface 53 of the lamp socket 43; simultaneously, the copper wires 40 on both sides of the lower body 34 of the bulb socket 23 will be unable to contact with the copper connectors 46 of the lamp socket 43; in other words, no danger is involved upon plugging.

Figure 6:
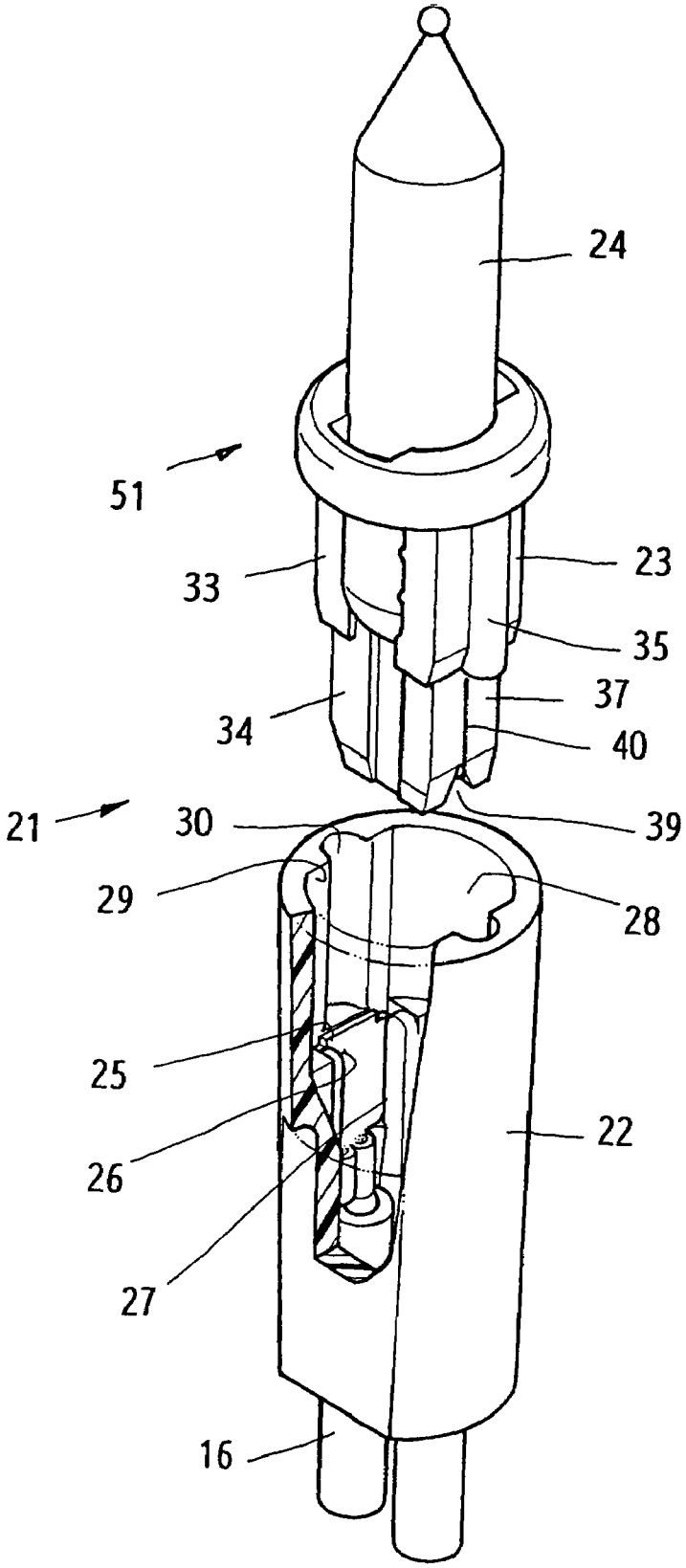
FIG. 6 is a disassembled view-1 of the lamp assembly in a twinkle flash-lamp string.
Figure 7:
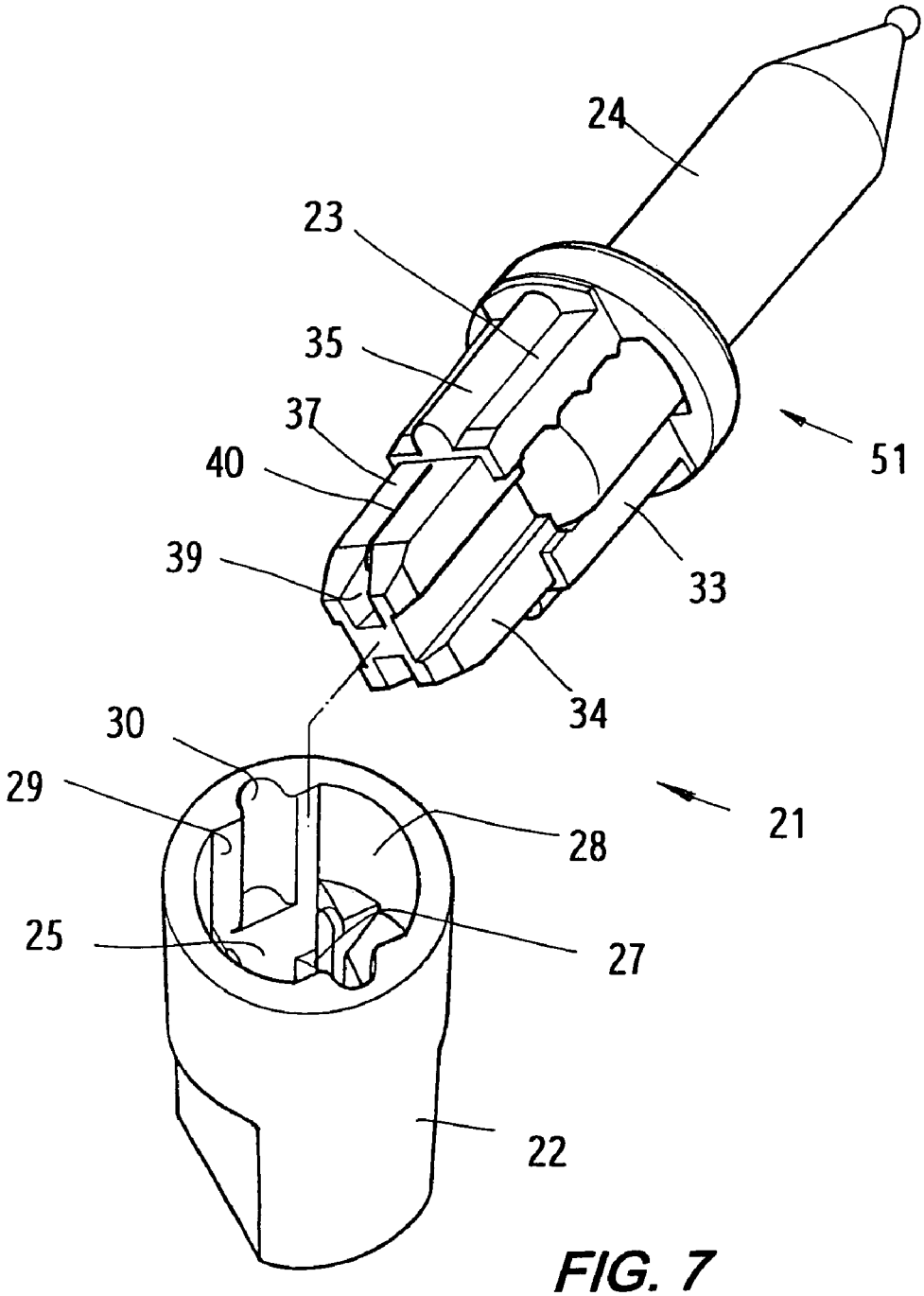
FIG. 7 is a disassemble view-2 of the lamp assembly in a twinkle flash-lamp string.
Figure 8:
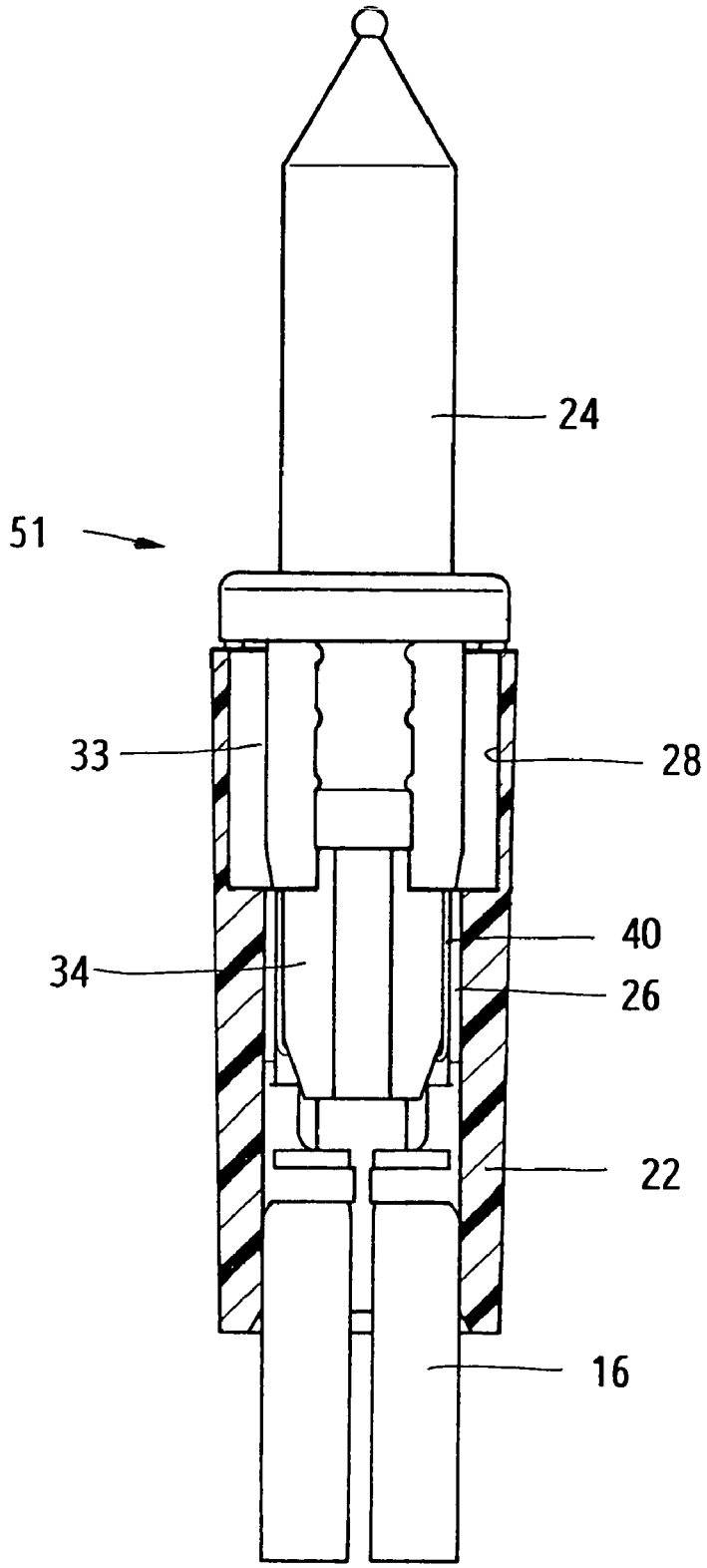
FIG. 8 is a sectional view of a lamp assembly in a twinkle flash-lamp string.
Figure 9:
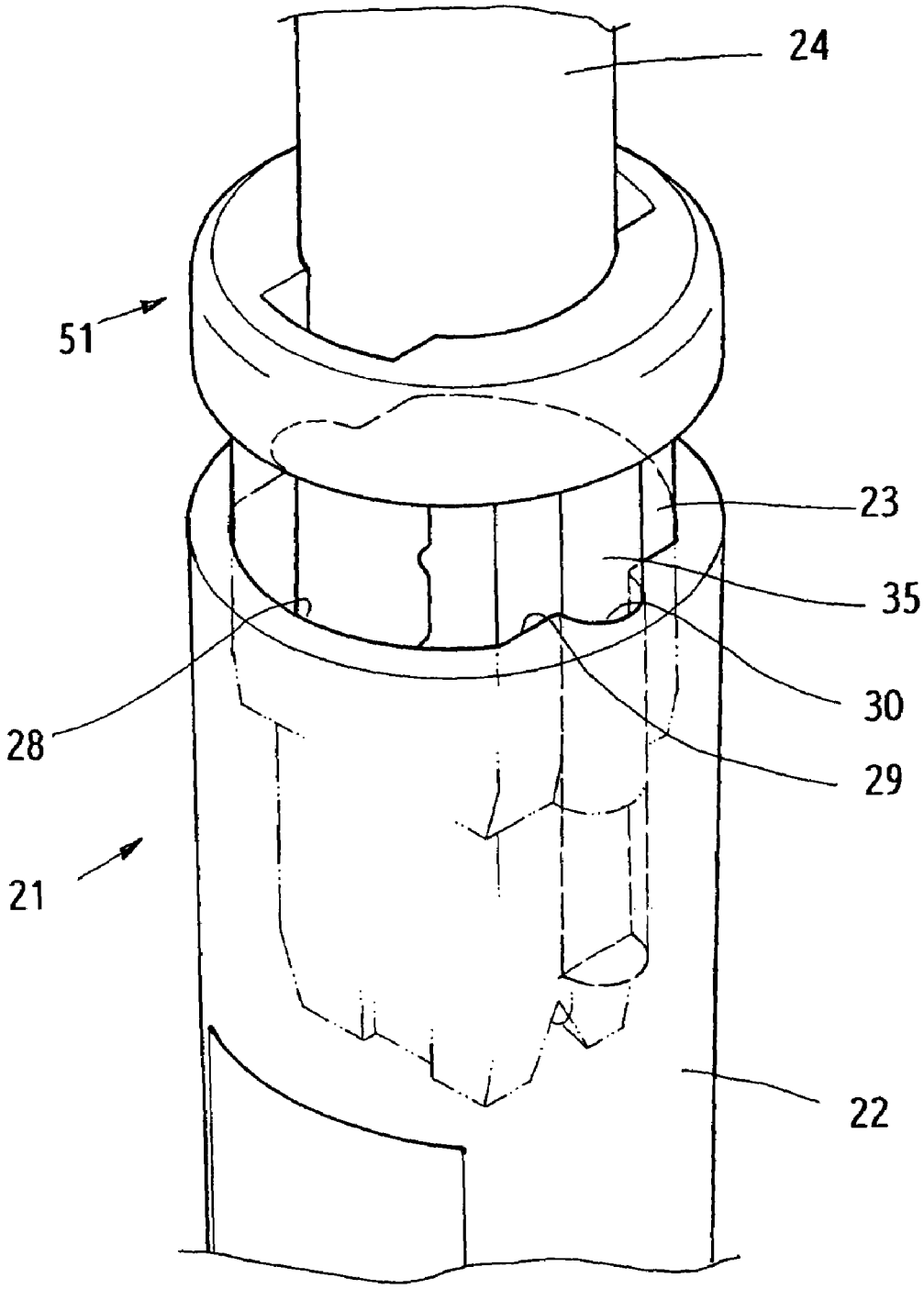
FIG. 9 is a side view of a lamp assembly in a twinkle flash-lamp string.

One main power-supply cable 14 is connected with two different flash-lamp strings 12 and 13, of which the lamp assemblies 20 and 21 have the same outer shape. As shown in FIGS. 2 and 5, the bulb assembly 50 of the lamp assembly 20 in the regular flash-lamp string 12 can only be plugged in the mated lamp socket 43. As shown in FIG. 11, when the bulb assembly 50 of the regular flash-lamp string 12 is tried to plug in the cylindrical cavity 28 of the lamp socket 22 in the winkle flash-lamp string 13, the bevel surface 56 of the upper body 54 of the bulb socket 44 will be hindered on the cylindrical cavity 28 of the lamp socket 22 because of the diameter of the bevel surface 56 being larger than that of the two vertical surfaces 29. As shown in FIGS. 6 and 9, the bulb assembly 51 of the winkle flash-lamp string 13 can only be plugged in the mated lamp socket 22. As shown in FIG. 10, the bulb assembly 51 of the winkle flash-lamp string 13 is unable to plug in the lamp socket 43 of the regular flash-lamp string 12 because of the two flanges 35 of the bulb socket 23 being hindered with the top surface 53 of the cylindrical cavity 49 of the lamp socket 43 of the regular flash-lamp string 12; therefore, the assembling and connection operation can not be done.

The flash-lamp system 11 according to the present invention comprises a regular flash-lamp string 12 mounted with lamp assemblies 20 and a winkle flash-lamp string 13 mounted with lamp assemblies 21, which are two different flash-lamp strings to be connected, in parallel, with a main power-supply cable 14; however, the two kinds of lamp assemblies 20 and 21 are the same in outer shape, but are different in the plugging and connecting structure; in other words, the bulb assemblies 50 and 51 between the two lamp assemblies 20 and 21 can not be plugged and connected together in a exchangeable manner so as to prevent from danger possibly occurred.

According to the aforesaid description of the embodiment of the present invention, the features and structure of the present invention have been disclosed completely; it is apparent that the present invention has provided obvious improvement, which is never anticipated and achieved by any person in the field; therefore, the structure thereof is deemed unique.

What is claimed is:

1. An assembly of a flash-lamp string system comprising:

a main power-supply cable to be connected in parallel with two ends of a plurality of flash-lamp strings;

a plurality of regular flash-lamp strings made of a plurality of lamp assemblies connected in series, an outer shape of each said lamp assembly being the same as that of a lamp assembly in a winkle flash-lamp string; each said lamp assembly including:

(a) a bulb assembly made of a bulb and a bulb socket; a center of said bulb socket having a bulb-plugging hole, and having a round upper body, and a lower body in a rectangular shape; said bulb being a regular bulb, which having two copper wires to pass through holes in a lower portion of said regular bulb socket, and then bent to contact with two flat surfaces respectively;

(b) a lamp socket furnished with a cylindrical cavity in an upper center thereof, and a lower portion of said cylindrical cavity having a rectangular groove; both sides of said rectangular groove having two copper connector grooves respectively, which are used for mounting two copper connectors mounted on two power-supply wires respectively;

a plurality of winkle flash-lamp strings made of a plurality of lamp assemblies connected in series, with an outer shape of each said lamp assembly being the same as that of said regular flash-lamp string; each said lamp assembly including:

(a) a bulb assembly made of a bulb and a bulb socket; a center of said bulb socket having a bulb-plugging hole, and having a rectangular lower body, and a larger rectangular upper body; both sides of said bulb socket furnished with two flanges respectively so as to have said upper body of said bulb socket not plugged in a lamp socket of a regular bulb assembly; said bulb being designed as a winkle bulb, of which two copper wires pass through two holes on a lower portion of a regular bulb assembly and then closely contact on two flat surfaces respectively;

(b) a lamp socket furnished with a cylindrical cavity in an upper center thereof, and two vertical surfaces and two mounting grooves on both sides of said cylindrical cavity for receiving said two flanges respectively; said cylindrical cavity used to prevent a bulb assembly of a regular flash-lamp string from plugging in; a lower portion of said cylindrical cavity furnished with a rectangular groove which has two copper connector grooves on both sides thereof for mounting two copper connectors on two ends of two power-supply wires respectively.

2. An assembly of a flash-lamp string system as claimed in claim 1, wherein said regular flash-lamp string includes a plurality of lamp assemblies and a regular flash bulb assembly mounted in a lamp socket.

3. An assembly of a flash-lamp string system as claimed in claim 1, wherein said winkle flash-lamp string includes a plurality of lamp assemblies and at least two winkle bulb assemblies mounted in lamp sockets.

4. An assembly of a flash-lamp string system as claimed in claim 1, wherein each top surface of said socket in said lamp assemblies of said regular flash-lamp string is smaller in size than that of said lower portion of said upper body of said winkle flash-lamp string so as to prevent a bulb assembly of a winkle flash-lamp string from plugging in a socket of said regular flash-lamp string.

5. An assembly of a flash-lamp string system as claimed in claim 1, wherein each top surface of said socket in said lamp assemblies of said winkle flash-lamp string is furnished with a non-standard cylindrical cavity so as to prevent a bulb assembly of said regular flash-lamp string from plugging in a lamp socket of said winkle flash-lamp string.

* * * * *